United States Patent [19]

Fletcher et al.

[11] 4,165,700

[45] Aug. 28, 1979

[54] THREAD SEPARATING FINGER

[75] Inventors: Roy W. Fletcher, Riverdale; Anthony D. Forte, Chicago, both of Ill.

[73] Assignee: Union Special Corporation, Chicago, Ill.

[21] Appl. No.: 956,464

[22] Filed: Oct. 30, 1978

[51] Int. Cl.[2] ..... D05B 65/02

[52] U.S. Cl. ..... 112/286; 112/297

[58] Field of Search ..... 112/286, 291, 293, 294, 112/297, 70, 68

[56] References Cited

U.S. PATENT DOCUMENTS

| | | | |
|---|---|---|---|
| 1,050,998 | 2/1913 | Horton | 112/286 |
| 1,395,274 | 11/1921 | Hagelstein | 112/286 |
| 2,858,786 | 11/1958 | Benink et al. | 112/68 X |
| 3,386,402 | 6/1968 | Ross | 112/286 |
| 3,463,105 | 8/1969 | Aoyama | 112/297 |
| 3,783,813 | 1/1974 | Kroll | 112/252 |
| 3,935,827 | 2/1976 | Winter | 112/286 |
| 3,994,249 | 11/1976 | Hsiao | 112/68 |

*Primary Examiner*—H. Hampton Hunter

*Attorney, Agent, or Firm*—J. Arthur Swanson; John A. Schaerli

[57] ABSTRACT

A thread separating finger used in combination with a knife assembly adapted for cutting thread utilized in a sewing machine with said assembly having first and second levers, each lever having first and second end portions and a medial portion therebetween, said first end portion of said second lever defining a first cutting blade portion, first means at said second end portion of said second lever for mounting said second lever for pivotal movement, a link having first and second end portions and a medial portion therebetween, said first end portion of said link defining a second cutting blade portion cooperative with said first cutting blade portion for cutting a thread therebetween upon relative pivoting motion between said link and said second lever, second means pivotally connecting together said medial portions of said link and second lever, and third means pivotally connecting together the first end portion of said first lever and the second end portion of said link whereby motion imparted to the second end portion of said first lever creates said relative pivoting motion between said link and said second lever to cut a thread adapted to be disposed between said first and second cutting blade portions. The thread separating finger moves into the loop of thread ahead of the cutting blades and separates the legs of the loop to insure that only one of the legs will be cut.

2 Claims, 6 Drawing Figures

THREAD SEPARATING FINGER

This invention relates to a thread separating finger for use with a thread cutting mechanism of a group stitch type machine adapted for use in the attachment of articles, such as buttons, to garments or fabrics intended for the production of garments.

BACKGROUND OF THE INVENTION

Sewing machines of the group stitch type adapted for use in the attachment of articles have clamping means for holding the workpiece that is horizontally vibrated in one or more directions and are normally equipped with either a manual or automatic thread cutter. Upon the completion of the group stitching operation the clamping means is released and/or raised away from the work and simultaneously the thread cutting mechanism is actuated. The thread cutter severs the thread as close to the work as possible and leaves as much thread hanging from the needle for performance of a similar group-stitching operation upon a next button or other article to be attached to a workpiece. Prior to the cutting cycle the thread normally extends down from the last stitch though the needle hole in the needle plate and around the butterfly hook and then up through the needle hole, the workpiece and the needle eye to the thread supply. At the point of severing the two thread legs are very close together and often both legs are cut, resulting in an insufficient amount of thread hanging from the needle for performance on the next button or article to be sewn on the work piece. The needle will at times become unthreaded.

SUMMARY OF THE INVENTION

The invention here under consideration is a thread separating finger used in conjunction with a scissor type thread trimming mechanism disclosed in U.S. Pat. No. 3,994,249 to Hsiao granted Nov. 30, 1976 to move the supply thread leg out of the way of the thread cutter to insure that only the thread leg from the last stitch is severed therefore leaving sufficient length of thread in the remaining leg (thread supply) for performing on the next group stitching operation. The finger is flat with its sides making an acute angle at the separating end and moves along with the upper knife blade.

It is therefore an object of this invention to provide a thread separating finger for a scissors type thread cutting mechanism for a group stitch type sewing machine to insure that only the thread leg from the last formed stitch will be severed.

Another object of the invention is to provide a thread separating finger for a scissors type thread cutting mechanism for a group stitch type sewing machine to insure that after the last formed stitch thread leg is cut there is sufficient length of thread in the thread supply leg for performing at the next group stitching operation.

Another object of the invention is to provide a thread separating finger for a scissors type thread cutting mechanism for a group stitch type sewing machine that is adjustably secured to the upper knife blade to afford easier adjustment of the thread cutting assembly.

With the above objects, features, and advantages of the invention in mind, an illustrative embodiment of the same will now be described in some detail in relation to the accompanying drawings in which.

Figure 2:
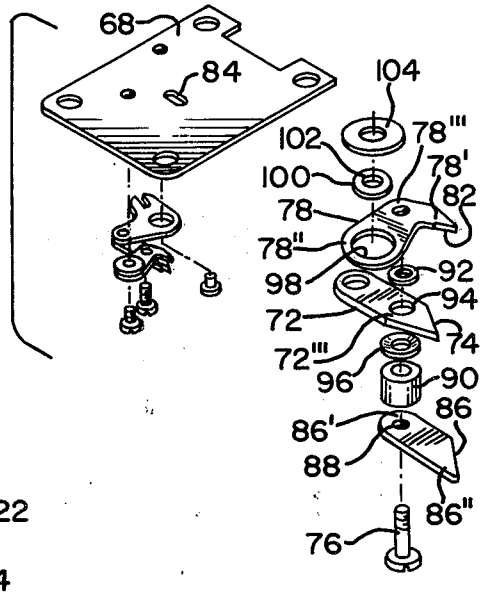
FIG. 2 is an exploded view of the thread cutting means.

The sewing machine illustrated in the drawings wherein is embodied the present invention is a group stitch machine of the general type disclosed in U.S. Pat. No. 2,609,773 to Nelson granted Sept. 9, 1962, U.S. Pat. No. 3,509,838 to Bowin granted May 5, 1970, U.S. Pat. No. 3,749,041 also to Bowin granted July 31, 1973, and U.S. Pat. No. 3,994,249 to Hsiao granted Nov. 30, 1976. The type of machine shown in these patents is a button sewing machine which includes button positioning means and work clamping means which is moved into clamping position at the beginning of the sewing cycle and lifted away from said position after a predetermined number of stitches is formed to secure a button to a workpiece. Also shown in each patent is an automatic thread trimmer that at the end of the sewing cycle cuts or interrupts the thread near the sewn button. To simplify the drawings, the button positioning and clamping means are not shown. It also should be pointed out that the thread cutting mechanism shown is that shown in the Hsiao patent.

Figure 1:
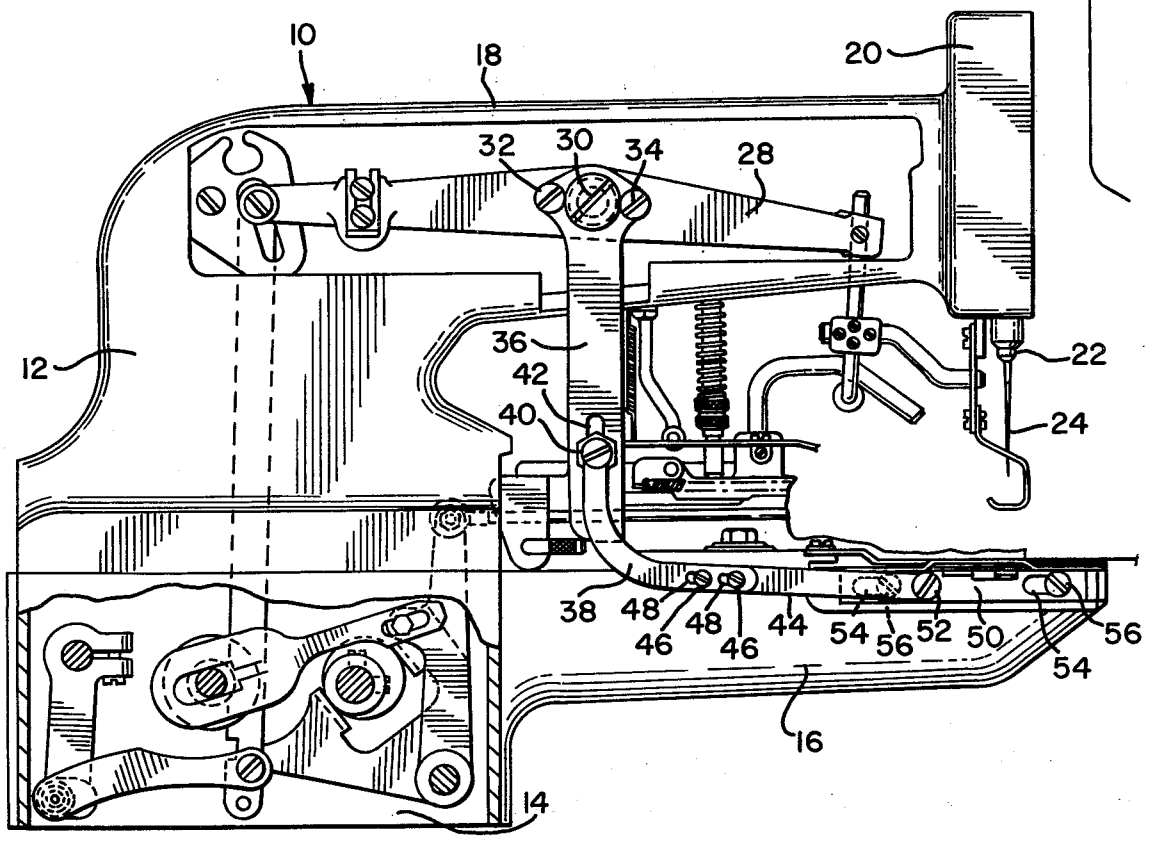
FIG. 1 is a partial side view of a button sewing machine partially broken away.
Figure 6:
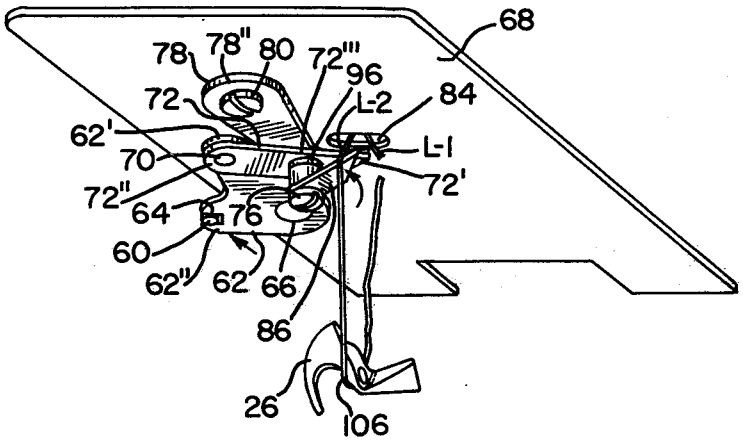
FIG. 6 is an isometric view of the thread cutting means in the engaged position.
Figure 5:
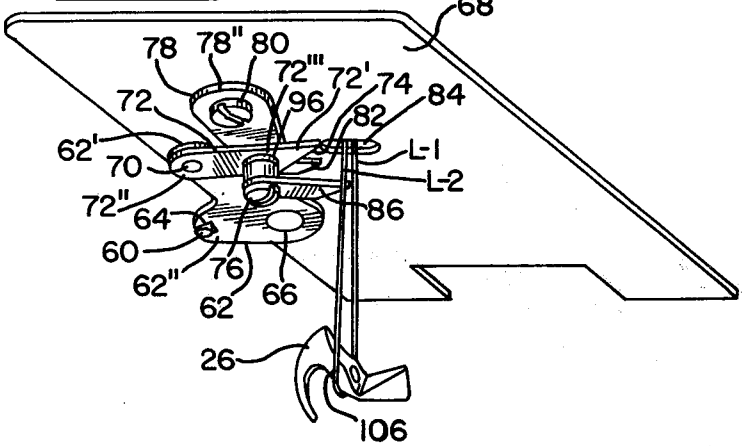
FIG. 5 is an isometric view of the thread cutting means in the unengaged position.

Referring now to the drawings and more particularly to FIG. 1 wherein is shown a button sewing machine 10 which has an enclosed frame including a vertical standard 12 having a base portion 14 at its lower end for mounting on a suitable support (not shown). Extending horizontally and, for the purposes of this description, forwardly from the base portion 14 is a work supporting arm 16. Above the latter, and extending outwardly and forwardly from the vertical standard 12 of the frame is an overhanging arm 18 which, at its forward end, has a head 20 in which is mounted a vertically reciprocable needle bar 22 adapted to carry a needle 24 for movement through the work supported upon the arm 16. As shown in FIGS. 5 and 6 the machine is also provided with a butterfly hook 26 of one conventional type which cooperates with the needle 24 in the formation of stitches. It will be understood that suitable connections are provided on the frame of the machine for driving the needle bar 22 and rotating the butterfly hook 26 in properly timed relation for forming the desired stitches, and such mechanism not shown in full detail herein since it is all well known in the art.

Figure 4:
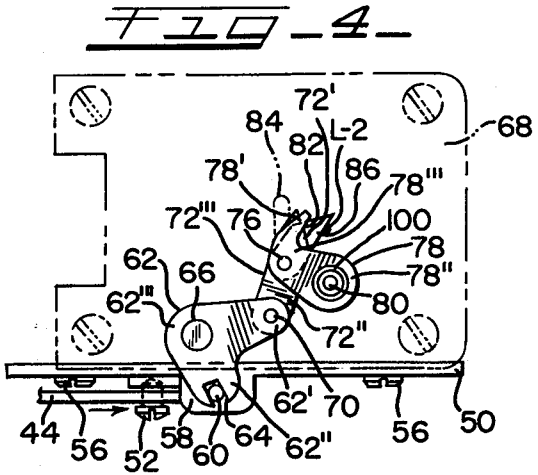
FIG. 4 is a top view of the thread cutting means in the engaged position.
Figure 3:
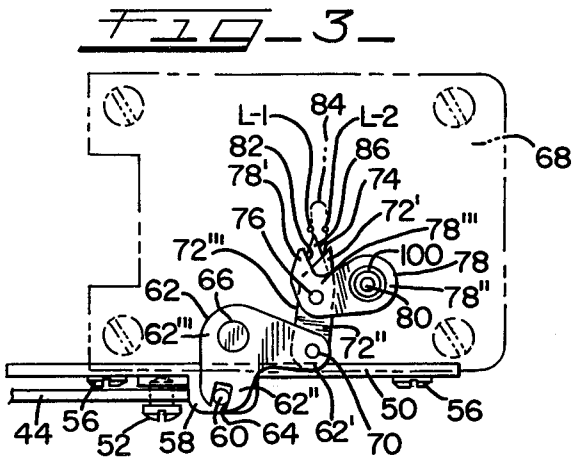
FIG. 3 is a top view of the thread cutting means in the unengaged position.

Turning now to the needle thread cutting mechanism which is operated by the counter clockwise rocking of lever 28 about its pivot 30 as shown in FIG. 1. Secured to the lever 28 by screws 32 and 34 is a downwardly extending arm 36. Adjustably and pivotly attached to the lower portion of arm 36 is the vertical portion of an L shaped link 38 by bolt 40 passing through elongated slot 42 in arm 36. The right end of the horizontally extending portion of link 38 is adjustably connected to link 44 by screws 46 passing through elongated slots 48 in link 38 and threaded into round openings in link 44. Some adjustment of the length of the overall linkage is made possible in this manner. At its right end, the link 44 is pivotly connected with a slide bar 50 by means of screw 52 threaded into opening in the slide bar. The slide bar is adapted for horizontal movement by the cooperation of openings 54 extending through the bar with screws 56 threaded into openings in the arm 16 of the frame of the sewing machine. The slide bar has a horizontal section 58 located on its upper side approximately in the center. The horizontal section contains a pin means 60 extending upwards as shown in FIGS. 3 and 4. Positioned adjacent to the horizontal section is a knife driving lever or bell crank lever means 62 having a first end portion 62', a second end portion 62'', and a medial portion 62''', shown in FIGS. 2, 3, 4, 5 and 6. The second end portion 62'' contains a slot 64 into which pin means 60 fits. Bell crank lever means 62 is pivotally secured at its medial portion 62''' by pivot 66 contained on the under side of the needle plate 68 and is capable of rotating a number of degrees therearound. The first end portion 62' of the bell crank lever means 62 is pivotally connected by a pivot 70 to the second end portion 72'' of a link or lower knife 72 also having a first end portion 72' and a medial portion 72'''. The first end portion 72' defines the cutting blade portion, the knife edge extending along edge 74. The lower knife 72 is in turn pivotally connected at its medial portion 72''' by a pivot 76 to the medial portion 78''' of the upper knife means 78. Upper knife means 78 also has a first end portion 78' and a second end portion 78'' which the latter is pivotally secured by a pivot 80 to the under side of the needle plate 68. The upper knife means 78 is generally L shaped with the first end portion 78' defining the cutting blade portion, having the knife edge extending along edge 82. Being of the L shape the upper knife cutting blade portion 82 is adjacent to the lower knife cutting blade portion 74. The arrangement of these two knife means 72, 78 is such that when the bell crank lever means 62 is pivoted a true scissors action is achieved between the two knife edges 74, 82 with the knife blades moving either toward or away from the needle hole 84 in the needle plate 68. Movement is towards the needle hole 84 when the slide bar 50 moves towards the front end of the sewing machine thus rotating the bell crank 62 counterclockwise as in FIGS. 3 and 4. The upper knife means second end portion 78'' contains a hole 98 into which bearing 100 fits. Pivot 80 which is a screw in the preferred embodiment passes upward through hole 102 of bearing 100 and through spacer 104 and into threaded hole in the underside of the needle plate 68. Since bearing 100 is thicker than upper knife 78 and the head of screw 80 is larger in diameter than bearing 100, the screw head supports upper knife means 78. The diameter of hole 102 in bearing 100 is larger than the diameter of screw 80, therefore allowing screw 80 some freedom. This allows some adjustability of aligning blades 74 and 82 to properly engage the thread. The necessary alignment is made to adjust the knife points with respect to needle hole 84 before screw 80 is tightly torqued to lock the elements into position. Thread separating finger means 86, having a first end portion means 86' and a second end portion means 86'' is adjustably secured to medial portion 78''' of upper knife means 78 by pivot 76, a screw in this embodiment. First end portion means 86' contains a hole means 88 and second end portion means 86'' defines a thread loop spreading implement. Screw 76 passes upward through hole 88 in the finger means 86 through separator spacer 90, through spring washer 96, through bushing 92 located in hole 94 of medial portion means 72''' of lower knife means 72 and is threaded into medial portion means 78''' of upper knife means 78. This arrangement secures thread separator finger means 86 to upper knife means 78, therefore moving along with the upper knife blade 82. Loosening screw 76 will enable separator finger means 86 to be repositioned angularly, advanced or retarded, with respect to upper knife blade 82. Bushing means 92 is thicker than lower knife means 72 into which it fits therefore allowing spring washer 96 to fit around bushing means 92 and inbetween lower knife means 72 and separator spacer 90 biasing lower knife means 72 upward against upper knife means 78. This biasing results in an excellent scissors cutting action from the knife blades 74 and 82.

Operation of the thread trimming mechanism and thread separating finger is best explained by viewing FIGS. 3, 4, 5 and 6. After the last stitch has been sewn the machine is stopped with butterfly hook 26 in the general position as shown in FIGS. 5 and 6 with thread 106 around hook 26, leg L-1 coming from the last stitch sewn and leg L-2 coming from the needle 24. As seen in FIG. 1 lever 28 is rocked counterclockwise resulting in downward extending arm 36 swinging counterclockwise. This in turn moves the horizontal leg of L shaped link 38 forward moving link 44 forward resulting in slide bar 50 sliding forward. Therefore pin means 60 moves forward rotating knife driving lever means 62 counterclockwise about pivot 66 as shown in FIG. 3, resulting in lower knife means 72 moving upward. This in turn rotates upper knife means 78 about pivot means 80 resulting in movement of both upper and lower knife means 78 and 72 toward thread legs L-1 and L-2 and a scissor action between the two knife blades 74 and 82. At this same time thread separating finger 86 moves in an arcuate path having pivot means 80 as its center of rotation.

The finger moves inbetween thread legs L-1 and L-2 and separates them by moving leg L-2 towards the forward end of the machine as shown in FIG. 6. As this is happening knife edges 74 and 82 move toward thread leg L-1 and their scissors action cuts thread leg L-1 just underneath the bottom surface of needle plate 68. Therefore at the beginning of the thread cutting cycle, thread separating finger 86 moves into the needle thread loop ahead of knife blades 74 and 82 moving thread supply leg L-2 away from last stitch thread leg L-1 insuring that knife blades 74 and 82 will only cut last stitch thread leg L-1. Without thread separating finger 86 it is necessary to adjust knife means 78 and 72 to trim last stitch thread leg L-1 and miss thread supply leg L-2. This adjustment, accomplished by the combination of shifting position of bearing 100 of upper knife means 78 and lengthening or shortening the link combination of links 38 and 44, is somewhat complicated. With thread separating finger 86 it is necessary to only adjust knife means 78 and 72 to trim last stitch thread leg L-1 because thread separating finger 86 has moved thread supply leg L-2 out of the way of the knife blades 74 and 82. This is a somewhat simpler adjustment. Additionally, adjustment of thread separating finger 86 is accomplished by the loosening of screw 76, repositioning finger 86 and retightening screw 76, this being rather simple. Therefore, these adjustments are necessary so that after the last stitch of a cycle is sewn and the machine stops, then the knife mechanism is actuated and moves toward the thread legs L-1 and L-2 with the thread separator 86 moving into the needle thread loop moving the thread supply leg L-2 aside and then the knife blades moving in cutting the last stitch thread leg L-1 with a scissor action.

Having thus described the invention, what is claimed herein is:

1. In combination with a knife assembly adapted for cutting thread utilized in a sewing machine, said assembly having first and second levers, each lever having first and second end portions and a medial portion therebetween, said first end portion of said second lever defining a first cutting blade portion, first means at said second end portion of said second lever for mounting said second lever for pivotal movement, a link having first and second end portions and a medial portion therebetween, said first end portion of said link defining a second cutting blade portion cooperative with said first cutting blade portion for cutting a thread therebetween upon relative pivoting motion between said link and said second lever, second means pivotally connecting together said medial portions of said link and second lever, and third means pivotally connecting together the first end portion of said first lever and the second end portion of said link creates said relative pivoting motion between said link and said second lever to cut a thread adapted to be disposed between said first and second cutting blade portions wherein the improvement comprises a thread separating finger means for moving into a loop of needle thread ahead of said first and second cutting blade portions and separating the legs of said loop to insure that only one of said legs will be cut by said first and second cutting blade portions, including: first and second end portions, said second end portion defining said thread loop spreading implement and means for adjustably securing said first end portion to said medial portion of said second lever.

2. In a knife assembly as set forth in claim 1 the further improvement wherein said adjustable securing means includes said second means pivotally connecting together said medial portion of said link and said second lever.

* * * * *